United States Patent [19]

Pfeiffer et al.

[11] Patent Number: 4,508,943

[45] Date of Patent: Apr. 2, 1985

[54] WALL COMMAND SWITCH

[75] Inventors: James W. Pfeiffer, Santa Clara; Thomas E. Corder, Martinez, both of Calif.

[73] Assignee: Security Switch, Ltd., San Ramon, Calif.

[21] Appl. No.: 479,382

[22] Filed: Mar. 28, 1983

[51] Int. Cl.[3] ..... H01H 3/00

[52] U.S. Cl. ..... 200/17 R; 200/33 R

[58] Field of Search ..... 200/5 A, 6 R, 6 B, 6 BA, 200/6 BB, 6 C, 33 R, 303, 304, 305, 314, 315, 329, 339, 17 R, 18; 307/141

[56] References Cited

U.S. PATENT DOCUMENTS

| | | | |
|---|---|---|---|
| 3,178,522 | 4/1965 | Passarelli, Jr. | 200/6 C |
| 3,290,454 | 12/1966 | Hubert | 200/5 R |
| 3,588,391 | 6/1971 | Banathy et al. | 200/6 BB X |
| 3,784,765 | 1/1974 | Daly | 200/18 X |
| 4,015,139 | 3/1977 | Cleary et al. | 200/33 R X |
| 4,115,670 | 9/1978 | Chandler | 200/18 X |
| 4,129,763 | 12/1978 | Murata | 200/5 A X |

*Primary Examiner*—J. R. Scott

*Attorney, Agent, or Firm*—Thomas S. MacDonald; Alan H. MacPherson

[57] ABSTRACT

A wall command switch (10) comprising a main frame (9) insertable over a conventional switch plate (50) and having a base portion (20) and an essentially planar pressure plate (15) rockably mounted within the base portion and substantially co-extensive therewith. An electrical switch (28) is mounted on the bottom surface of the main frame and a switch operator (35) is attached to the pressure plate in alignment with operable portions of the electrical switch so that rocking of the pressure plate moves the operator into engagement with the electrical switch. Structure in contact with the pressure plate to return the pressure plate to an unrocked position is provided. The base portion (20) also mounts a vertically moving override switch operator (55) which in turn moves through an actuator (70) an inwardly located position switch (77) which can allow automatic-manual or off functions of a light electrically connected to the command switch.

19 Claims, 11 Drawing Figures

FIG.1
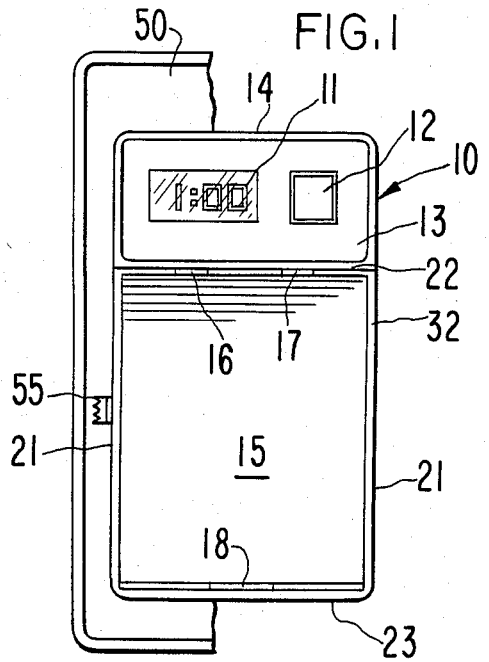
FIG.2
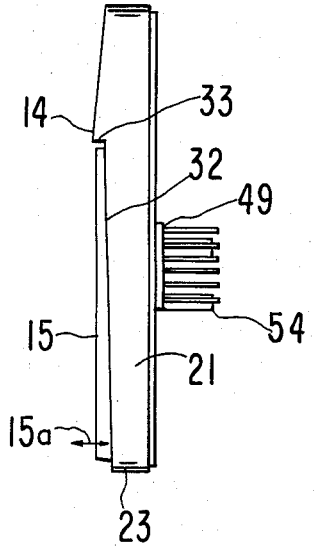
FIG.3
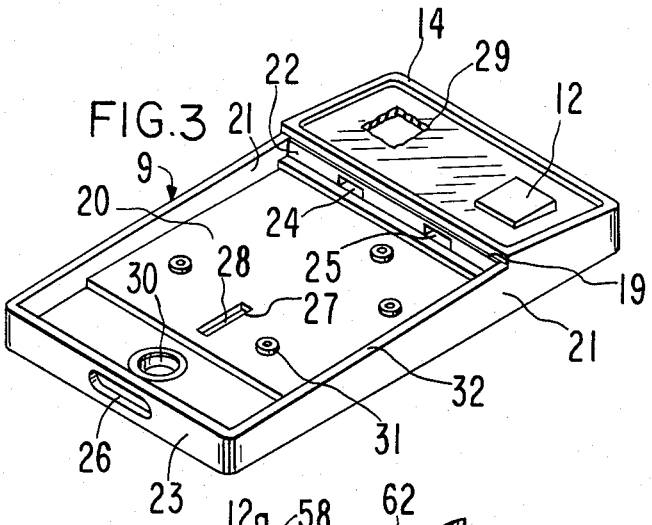
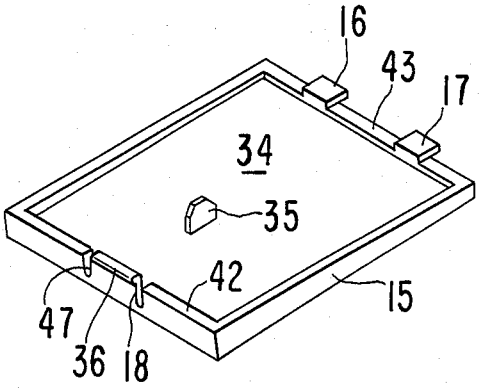
FIG.4
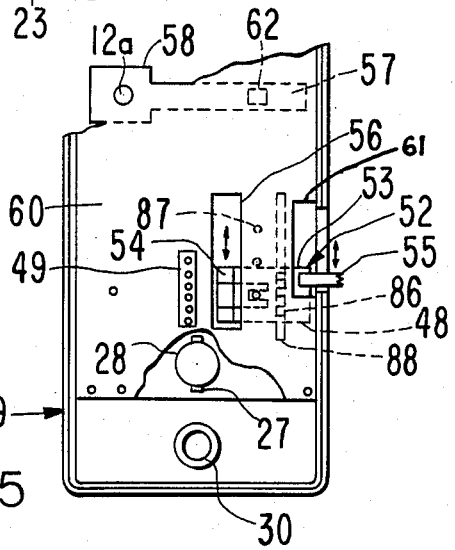
FIG.5
FIG.6
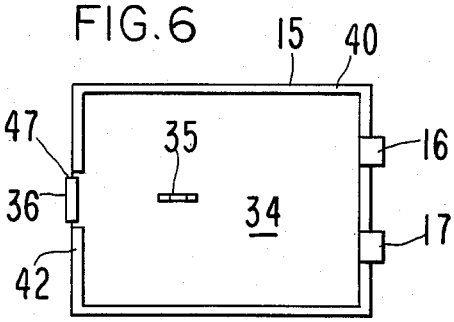
FIG.7
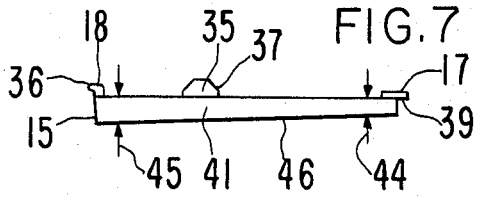

WALL COMMAND SWITCH

CROSS-REFERENCE TO RELATED APPLICATION

This application is related to U.S. Application Ser. No. 408,330 filed on Aug. 16, 1982 and assigned to the Assignee of the present invention and which is incorporated herein by reference.

BACKGROUND OF THE INVENTION

The present invention relates to a wall switch which is operable to control incandescent local lights. It replaces an ordinary single pole or three-way pull toggle wall switch and uses a standard wall-recessed outlet box single or multi-gang and wall switch plate. The wall switch may be a part of a programmable switch used for the automatic turning on and off of various lights in a home, office or factory and the dimming of such lights in accordance with a computer programmed system. The command switch of this invention is mountable on the normal face plate of a wall switch and covers the screw fastening means normally associated with such wall mounted switch plate. The switch may be termed a "pressure pad" switch which operates to turn the light circuits to an on or off condition. It is used in conjunction with a mechanical override switch for the computer operation of the overall programmable switch and various circuits used in the programmed system.

DESCRIPTION OF PRIOR ART

For many years the standard on/off switch in American homes has been the so-called toggle single throw switch which is mounted in a rectangular aperture centrally of a face plate which covers a standard outlet box mounted in an aperture between the studs of a building wall or in other internal spaces. The toggle switch may either be of a mechanical configuration of it may be the so-called quiet mercury switch. Heretofore various push button switches have also been used with face plates and standard outlet boxes as well as certain types of pad switches. U.S. Pat. No. 4,249,618 shows a timer module mounted on a conventional wall switch plate with connections extending through the rectangular slot normally utilized for the toggle switch of prior art devices. In this patent the timer module extends between the apertures for the connecting means utilized for attaching the face plate to a switch mounting bracket and in turn to tabs on the internal periphery of the outlet box recessed normally within a wall.

SUMMARY OF THE INVENTION

The present invention provides a wall command switch having a base portion adapted to be mechanically and electrically connected to an electrical wall switch box in which the base portion has a depressed bottom surface and raised perpendicular peripheral walls. A pressure plate is rockably mounted within the base portion and an electrical switch mounted in the bottom surface of the base portion. A switch operator is provided fixedly attached to the under surface of the pressure pad facing the bottom surface of the base portion so that rocking motion of the pressure plate moves the operator into engagement with the electrical switch. Means are also provided normally within the switch itself to return the switch plate to its normal unrocked position with respect to the base portion. The invention also contemplates the provision of a locking means for moveably locking the pressure plate to the base portion with sufficient allowance made for the rocking movement of the pressure plate with respect to the base portion. The pressure plate is also removable from the base portion by a slight upward movement of the pressure plate with respect to the base portion so as to release the locking means. Means are also provided to electrostatically isolate the switch from the computer command functions of the overall device. A further aspect of the invention is the provision of a side-mounted switch operator and interior switch actuator for overriding the computer control of the switching. A further aspect of this invention is in providing a LCD driver chip for control of the computer display positioned exterior of the internal switch box and separated from the integrated circuit performing the computer command functions.

BRIEF DESCRIPTION OF THE DRAWINGS

FIG. 1 is a top view of the pressure command switch showing it mounted on a conventional switch plate.

FIG. 2 is a side elevation view of the wall command switch.

FIG. 3 is a perspective view of the main frame of the wall command switch with the pressure plate removed.

FIG. 4 is perspective view of the underside of the pressure plate.

FIG. 5 is a partial rear view of the bottom of the main frame of the switch.

FIG. 6 is a plan view of the underside of the pressure plate.

FIG. 7 is a side elevation view of the pressure plate.

DETAILED DESCRIPTION OF DRAWINGS

Figure 9:
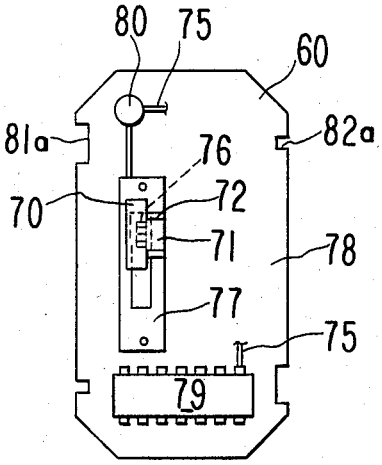
FIG. 9 is a plan view taken on line 9—9 of FIG. 8 of the printed circuit board mounting a position slide switch which is actuatable by the override switch of the invention.

Referring to FIG. 1, a wall command switch 10 is shown comprising a generally rectangular switch having an upper recessed command area 13 containing cutout windows for displaying indicia 11 such as time or programmed conditions and a push button control 12 for programming the computer aspects of the switch for various desired automatic functions. The programming and the computerized switching is explained in detail in U.S. patent application Ser. No. 408,330, filed Aug. 16, 1982.

The top of the recessed portion 13 is bounded by a top surface or ledge 14. A pressure switch plate 15 is provided which seats in a recess formed by the peripheral sidewalls 21, 22 and 23 and bottom surface 20 of main switch frame 9. Pivot lug means 16 and 17 are provided at the top of pressure pad 15 which lugs are insertable into apertures contained in the top peripheral wall 22 of the bottom recess portion of switch frame 9. A locking tab 18 is provided at the opposite end of the pressure pad 15 which interlocks into a recess in the bottom peripheral wall 23 of the frame recess. Top surface 32 extends around the periphery of the main frame.

As seen in FIG. 2 a notch 33 is provided between the raised edge 14 of the top portion 13 of the switch and the inner periphery of upper wall 22 to allow pivoting or rockable movement of pressure plate 15 (as shown by arrows 15*a*) about the top edge of pressure plate 15.

FIG. 3 shows the main frame 9 with the pressure plate removed. A depressed bottom surface 20 is defined by a series of peripheral walls, namely, sidewalls 21, upper wall 22 and lower wall 23. Rectangular aperture means 24 and 25 are provided in the top wall 22 below a small ridge 19 between the top surface 14 and the upstanding wall 22. Ridge 32 extends around the remainder of bottom recessed surface 20. An aperture 26 is provided in the bottom sidewall 23 which functions as a locking aperture. An aperture 27 is provided medially of the width of bottom 20 for ingress of a switch operator. Situated below the aperture 27 is a switch 28 normally of a spring press dome design which is fixedly attached to a printed circuit board (not shown) attached to the rear of the main frame 9. Aperture 30 is provided in the bottom surface 20 through which a conventional mounting screw may be inserted for attaching the main frame to the standard mounting bracket and mounting tabs in the standard outlet box. Preferably the upper mounting screw of the conventional wall switch plate is left in place and is covered by switch 10 with switch 10 mounted through aperture 30 using the lower screw aperture of the switch wall plate 50. Embossment means 31 may also be provided in the bottom recess surface if it is desired to threadedly attach various electronic components such as switch 28 to the rear side of the main frame. A transparent molded plastic lens 29 containing a cut-out for push button 12 is provided over the top portion 13 of the switch. Lens 29 cuts any electrostatic discharge, particularly that from a person actuating pad 15 or button 12. Such discharge may otherwise act to scramble display 11 or other components in the switch interior.

FIG. 4 shows the underside of the pressure switch plate 15. Pivot lug means 16 and 17 protrude from the edge portions of the underside 34 of the pressure plate. At the opposite end of pressure plate 15 a locking tab 18 is provided. Locking tab 18 has a degree of flexibility and has a bulbous locking lip portion 36 extending beyond the periphery of the outer edge of the pressure plate 15. Medially of the undersurface 34 of unitary pressure plate 15 is an integral switch operator 35. Pressure pad 15 is assembled into main frame 9 by placing tabs 16 and 17 into apertures 24 and 25. The pressure plate is then pivoted downwardly so that the lip 36 of locking tab 18 depresses inwardly as it passes down the inner surface of wall 23. When it reaches the inward top portion of aperture 26, it seats in that aperture to lock the pressure plate 15 within aperture 26. Aperture 26 has sufficient height so as to allow rocking and inward movement of the pressure plate around pivot lug means 16, 17 in apertures 24 and 25 so as to affect an on/off switch movement of the operator 35 against the spring press dome switch 28 mounted on the rear of the main frame. Pressure plate 15 may be removed from the main frame by merely pressing the lip 36 of locking tab 18 inwardly out of aperture 26 allowing the pressure plate to be pivotedly moved upwardly out of the frame where it may be then pulled from the recess by withdrawing the lugs 16 and 17 from their respective apertures 24 and 25. Locking tab 18 is separated from the upstanding wall 42 of the pressure plate 15 by a notch 47. Locking tab 18 has a degree of flexibility resultant from its cantilevered nature extending from the inner surface 34 of the pressure plate.

FIG. 5 shows a partial view of the rear of main frame 9 particularly showing the dome-type bubble switch 28 mounted across medial aperture 27 through which the switch operator 35 passes. Aperture 30 is the main attach point for the main frame to the switch mounting bracket (not shown) and the standard internally mounted wall box (not shown). Suitable electric leads 48 are provided from the switch to the circuit controlling the light or lights being switched on or off. Connector contacts 49 also protrude from the rear of the main frame and connect the electronics for example a LCD-driver chip 62 to the LCD display contained in the top section of the switch to other electronic components contained in the standard wall switch box as more particularly described in the aforementioned co-pending patent application.

FIG. 5 also illustrates a mechanical override switch 52 incorporated for reasons of safety. It is a three-position switch for computer command functions having automatic-manual-off positions as set forth in the co-pending application. Mechanically switch 52 comprises a flat rectangular portion 53 extending from slotted apertures 56 and 61 in circuit board 60. The switch is restrained in the PC board cut-out but is allowed to move to its operating positions. A molded fixed tab 55 extends from portion 53 outwardly of wall 21 (FIG. 1) and is vertically movable to the aforesaid three operating positions. A pair of spaced upstanding legs 54 extend from the other edge of portion 53 and are adapted to extend with contacts 49 into the slot (not shown) of the switch plate 50 to actuate an interior toggle switch (not shown).

An antistatic barrier 57, 58 comprising an aluminum or other metal foil is placed over the switch 12*a* and memory chip 62, respectively, on the inner side of circuit board 60 and under upper switch portion 13. This barrier statically isolates the switch and memory chip from electrostatic discharges from a person operating the multiswitches of the overall device.

FIG. 6 shows a top view of the underside of pressure plate 15 showing clearly the pivot lugs 16 and 17 of rectangular configuration and extending outwardly from the periphery of the plate 15. Locking tab 18 with its protruding lip 36 also extends beyond the periphery of the end of the pressure plate opposite the pivot lugs.

FIG. 7 is a side view of the pressure plate showing upstanding locking lug 18, its extending lip portion 36 and pivot lug means 17. Lug 17 extends a distance 39 beyond the wall of the pressure plate 15 so as to be capable of upward movement so as to release the lip 36 of the locking tab from aperture 26 of the main frame when the pressure plate is in assembled position. For ease of operation and to provide for more pivoting action, the pressure plate is normally thinner at 44 than at 45 forming a tapered vertical surface 46 extending on the exterior of the pressure plate 15.

The present invention thus provides for a command switch having a wide surface area which allows it to be operated either by a person's finger or a more blunt object such as an elbow, forehead or box edge. The main frame covers the mounting screw apertures for the conventional switch plate thus preventing unauthorized removal of the main switch plate 50 and its attached main frame and pressure plate from the wall. The absence of any observable mounting means will also deter children from trying to remove the switch plate and main frame and attached pressure pad from the wall. The pressure pad is compatible with a low cost click-type on/off dome switch. The device is mechanically simple yet highly reliable. The pivoting action of the pressure plate and particularly its tapered surface 46 provides for a mechanical advantage so that a very light force on the pressure plate actuates and deactuates switch 28. The main frame and the pressure plate may be made of mouldable material such as polycarbonate plastic.

Figure 8:
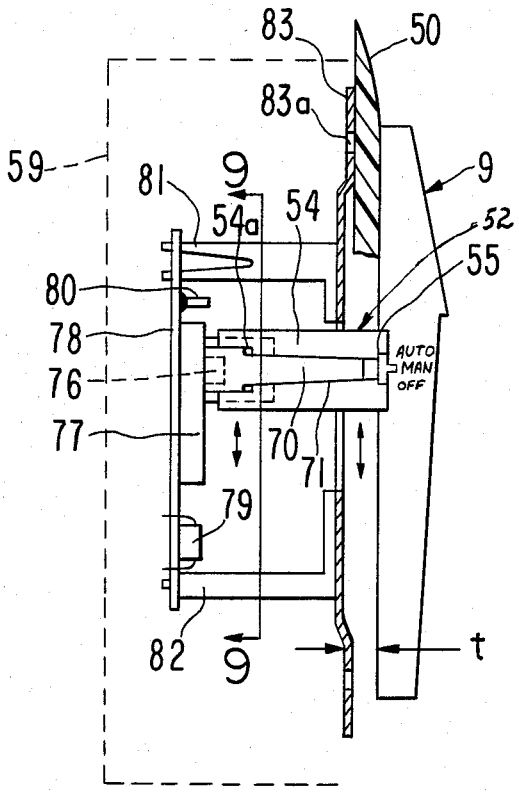
FIG. 8 is a partial cross-sectional view showing the assembly of the mechanical override switch in a wall-mounting.

FIG. 8 shows the assembly of command switch 9 to a standard outlet box 59 shown in general phantom lines. A metal mounting plate 83 is mounted by screws extending through apertures 83*a* to tabs (not shown) on the outlet box 59. A printed circuit board 78, to which are affixed the computer command integrated circuit chip package 79, other electrical components 80 such as transistors, resistors and the like and metallization patterns 75, is mounted on spring posts 81 and fixed posts 82 extending from plate 83. The posts fit into notches 81*a* and 82*a*, respectively, shown in FIG. 9. A conventional 3-position slide switch 77 with finger operator 76 is mounted on board 78 and electrically connected to the integrated circuit in chip package 79. A recess 74 in a switch actuator 70 is mounted over finger operator 76 and is positioned to move linearly with respect to the top surface of switch 77 thus moving the switch operator 76 to any one of its three positions. An override switch operator 52 having a pair of internally directed legs 54 forming a fork-like member is positioned on an outer narrowed post position 71 extending from a base 73. The post portion forms a ledge which in the "fully-in" position of legs 54 abuts an indentation 54*a* in the legs. This construction is seen more clearly in FIGS. 10 and 11. Linear movement up and down of override switch operator moves switch actuator 70 and in turn 3-position switch operator 76. Linear movement is assured by providing a slot 88 (FIG. 5) in the rear surface of bottom 20 of the command switch, in which rides an upstanding ridge 86 on the outwardly facing rectangular position 53 of the override switch operator. The legs 54 are slidable inward on post 71 over a relative wide range of wall depths compensating for the differing thicknesses of wall switch plates 50 which are mounted between command switch 9 and the structural wall of the home, office, or business. Thus the distance t can be varied to accommodate wall switch plate thicknesses. As previously described portion 53 is confined behind the slots 56 and 61 in FIG. 5.

FIG. 9 shows the mounting of the various elements on board 78 with switch actuator 70 positioned over slide switch operator 76. The override switch operator is not seen in FIG. 9.

Figure 10:
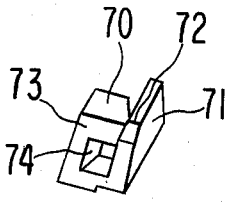
FIG. 10 is a perspective view of the switch actuator of the override switch.

FIG. 10 shows the switch actuator 70 with the recess 74 which is press fitted over operator 76. Post 71 extends outwardly when the actuator is in position.

Figure 11:
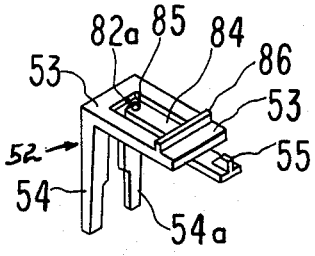
FIG. 11 is a perspective view of switch operator of the override switch.

FIG. 11 shows the details of the override switch operator having a generally rectangular position 53 and legs 54 forming a right angle fork portion the internal surfaces of which are in sliding engagement with edge portions of post 71 outwardly of ledge 72. A cut-out 82*a* is provided in portion 53 forming a cantilevered tongue 84 having a raised circular boss 85 thereon. Boss 85 is adapted to seat in one of three circular detents 87 in the rear surface of command switch bottom 20 (FIG. 5) so that a tactile response is felt when a user moves tab 55 up and down to the respective AUTO-MAN-OFF positions of the override switch. The override switch construction of the invention provides for linear movement of the respective operators and actuators, resisting the tendency of rotation of the finger manipulated tab 55.

Positioning of the LCD driver circuit outside the in-wall electronic package including the microprocessor controller chip, allows for only low digital signal voltages outside the switch box 59. Only six pins are needed to provide connection to the exterior mounted LCD-driver and the thirty-two multi-contacts needed for the liquid crystal display segments. If both chips were inside 32 more pins would be needed connecting command switch 9 to the printed circuit board 78. In a further embodiment of this invention the entire microprocessor unit including the LCD-drivers may be contained in a single chip version of the unit and mounted exteriorly of the switch box, e.g., in wall switch 10.

While the present invention has been described by reference to what is believed to be the most practical embodiment it is understood that the invention may embody other specific forms not departing from the spirit of the invention. Other embodiments possessing the qualifies and characteristics generally functioning in the same manner should be considered within the scope of this invention. The present embodiment is illustrative and is not to be restricted other than by the appended claims and equivalents thereof.

We claim:

1. A wall command switch comprising (a) a base portion; means for mechanically connecting said base portion to an electrical wall switch box, said base portion having a depressed bottom surface bounded by a raised peripheral wall perpendicular to said bottom surface;

(b) a rockable pressure plate at least partially mounted within the base portion and having a planar touch surface substantially co-extensive with and spaced from the inner periphery of said peripheral wall;

(c) an electrical dome-type bubble switch mounted adjacent to said bottom surface;

(d) a switch operator on an under inner surface of said pressure plate facing said bottom surface, said switch operator being in alignment with operable portions of said electrical switch whereby rocking movement of said pressure plate moves said operator into and out of engagement with said electrical switch; and wherein said bubble switch includes means in contact with said pressure plate for returning said pressure plate to its normal unrocked position with respect to said base portion upon removal of an actuating force on said pressure plate.

2. The invention as set forth in claim 1 including rectangular aperture means in the peripheral wall and that lug means extending from the pressure plate under surface, said lug means being insertible into said aperture means to provide said rockable mounting of said pressure plate.

3. The invention as set forth in claim 2 including a pair of spaced aperture means and a pair of spaced lug means interfitting therewith.

4. The invention as set forth in claim 1 including a locking aperture in the peripheral wall and a locking tab extending from the pressure plate interlocking with said locking aperture, said locking tab and said locking aperture being dimensioned so as to allow relative movement therebetween, in the locking position, provided by the rockable mounting of the base portion and said pressure plate.

5. A wall command switch comprising (a) a base portion adapted to be mechanically connected to an electrical wall switch box, said base portion having a depressed bottom surface bounded by a raised peripheral wall perpendicular to said bottom surface;

(b) a rockable pressure plate at least partially mounted within the base portion and substantially co-extensive with and spaced from the inner periphery of said peripheral wall;

(c) an electrical switch mounted adjacent to said bottom surface;

(d) a switch operator on an under inner surface of said pressure plate facing said bottom surface, said switch operator being in alignment with operable portions of said electrical switch whereby rocking movement of said pressure plate moves said operator into and out of engagement with said electrical switch;

(e) means in contact with said pressure plate for returning said pressure plate to its normal unrocked position with respect to said base portion; and wherein said pressure plate is rockably mounted to said base portion by lug means extending from an edge of said pressure plate into aperture means in a facing portion of said peripheral wall and a locking lug deposed on an opposite edge of said pressure plate adapted to movably lock said plate into a locking aperture in a corresponding opposite edge of said peripheral wall whereby the edges and under surface of said pressure plate is generally confined in said base portion and rockable therein upon imposition of a force upon the outer surface of the pressure plate.

6. A wall command switch comprising (a) a base portion adapted to be mechanically connected to an electrical wall switch box, said base portion having a depressed bottom surface bounded by a raised peripheral wall perpendicular to said bottom surface;

(b) a rockable pressure plate at least partially mounted within the base portion and substantially co-extensive with and spaced from the inner periphery of said peripheral wall;

(c) an electrical switch mounted adjacent to said bottom surface;

(d) a switch operator on an under inner surface of said pressure plate facing said bottom surface, said switch operator being in alignment with operable portions of said electrical switch whereby rocking movement of said pressure plate moves said operator into and out of engagement with said electrical switch;

(e) means in contact with said pressure plate for returning said pressure plate to its normal unrocked position with respect to said base portion; wherein the means to return said switch to its normal unrocked position is a spring press dome contained in said electrical switch; and said switch operator is an integral tab extending inwardly from a medial portion of the under surface of said pressure plate and wherein said base portion bottom surface includes medial aperture means, said electrical switch means being spring pressed into either on or off position and mounted adjacent to the underside of said base portion and oriented with said medial aperture means, said switch operator extending into said medial aperture means and being operable to push on said spring pressed electrical switch when a force is applied to the outer surface of said pressure plate.

7. The invention as set forth in claim 6 including pivot means at the one edge of said pressure plate adjacent to a portion of said peripheral wall and movable locking means at an opposite edge of said switch plate adjacent to another portion of said peripheral wall, whereby said pressure plate is rockable with respect to said base portion.

8. The invention as set forth in claim 7 in which movement of said pressure plate towards said pivot means unlocks said locking means permitting said pressure plate to be removed from said base portion.

9. A wall command lighting switch comprising (a) a base portion mechanically connected to one side of a mounting plate of an electrical wall switch box and positioned exteriorly of said switch box;

(b) a movable pressure plate at least partially mounted within said base portion;

(c) means for mounting a first electrical switch adjacent to and under a bottom surface of said base portion;

(d) first switch operator means connected to said plate and in alignment with operable portions of said first switch means whereby movement of said plate moves said first switch operator means into and out of operative engagement with said first switch means;

(e) a second switch operator means connected in sliding relationship to said base portion;

(f) a second electrical slide switch connected in spaced relation to the opposite side of said mounting plate and positioned internally of said switch box; and (g) means integrally extending from said second switch operator means and behind said base portion for connecting said second switch operator means to said second slide switch, said second electrical slide switch being movable into automatic or manual or off positions to automatically control lighting functions and wherein said first switch means is operable by movement of said plate in any position of said second slide switch.

10. The invention of claim 9 in which said second switch operator means comprises an operating tab extending exteriorly of and mounted to vertically move with said respect to said base portion, and said means for connecting comprises a planar base integral with said tab and slidably disposed on a rear surface of the base portion, leg means integral with and extending at an angle from said planar base, and a switch actuator connected to said second slide switch, said leg means engaging said switch actuator so that movement of said tab moves said second slide switch.

11. The invention of claim 10 including slot means in said bottom surface of said base portion, ridge means on said planar base, said ridge means being slidably mounted in said slot means and means connected to said base portion to slidingly confine said planar base in said slot means.

12. The invention of claim 10 including a boss extending from said planar base and a series of vertical detents on said rear surface of said base portion, said boss adapted to seat into one of said detents in each of the positions of said second slide switch.

13. The invention of claim 10 in which said switch actuator comprises a base member having a recess positionable over a switch operator on said slide switch and an integral post member to receive in abutting relation at least a partial length of said leg means whereby the depth of insertion of said base portion with respect to said second slide switch may be controlled dependent upon the thickness of any face plate interposed between said base portion and said mounting plate.

14. A wall lighting switch comprising (a) a base portion mechanically connected to one side of a mounting plate of an electrical wall switch box and positioned exteriorly of said switch box;

(b) switch operator means connected in sliding relationship to said base portion;

(c) an electrical slide switch connected in spaced relation to the opposite side of said mounting plate and adapted to be positioned internally of said switch box; and (d) means extending behind said base portion for connecting said switch operator means to the slide switch.

15. The invention of claim 14 in which said means for connecting comprises an operating tab extending exteriorly of and mounted to vertically move with said respect to said base portion, a planar base integral with said tab slidably disposed on a rear surface of the base portion, leg means integral with and extending at an angle from said planar base, and a switch actuator connected to said slide switch, said leg means engaging said switch actuator so that movement of said tab moves said slide switch.

16. The invention of claim 15 including slot means in said rear surface of said base portion, ridge means on said planar base, said ridge means being slidably mounted in said slot means and means connected to said base portion to slidingly confine said planar base in said slot means.

17. The invention of claim 15 including a boss extending from said planar base and a series of vertical detents on said rear surface of said base portion, said boss adopted to seat into one of said detents in each of the positions of said slide switch.

18. The invention of claim 15 in which said switch actuator comprises a base member having a recess positionable over a switch operator on said slide switch and an integral post member to receive in abutting relation at least a partial length of said leg means whereby the depth of insertion of said base portion with respect to said slide switch may be controlled dependent upon the thickness of any face plate interposed between said base portion and said mounting plate.

19. In a wall command lighting switch (a) a base portion mechanically connected to one side of a mounting plate of an electrical wall switch box and positioned exteriorly of said switch box;

(b) a liquid crystal display connected to said base portion to indicate the time for setting lighting time sequences, a liquid crystal driver integrated circuit chip attached to said base portion to operate said display;

(c) switch operator means connected in sliding relationship to said base portion;

(d) an electrical slide switch connected in spaced relation to the opposite side of said mounting plate and positioned internally of said switch box; and (e) means extending behind said base portion for connecting said switch operator means to the slide switch.

* * * * *

UNITED STATES PATENT AND TRADEMARK OFFICE

CERTIFICATE OF CORRECTION

PATENT NO. : 4,508,943

DATED : April 2, 1985

INVENTOR(S) : James W. Pfeiffer, Thomas E. Corder

It is certified that error appears in the above—identified patent and that said Letters Patent is hereby corrected as shown below:

Column 1, line 38, delete "of" and insert --or--.

Column 3, line 30, delete "switch wall" and insert --wall switch--.

Signed and Sealed this

*Fifteenth* Day of *October 1985*

[SEAL]

*Attest:*

DONALD J. QUIGG

*Attesting Officer*

*Commissioner of Patents and Trademarks—Designate*